US005397119A

United States Patent [19]

Brewster, Jr. et al.

[11] Patent Number: 5,397,119

[45] Date of Patent: Mar. 14, 1995

[54] SHEET FEEDING APPARATUS INCLUDING MEANS FOR FACILITATING FEEDING LOWERMOST SHEETS FROM A STACK THEREOF

[75] Inventors: William H. Brewster, Jr., Fairfield; Thomas M. Helit, Bethel; Paul R. Sette, Branford; Walter Wolog, Orange, all of Conn.

[73] Assignee: Pitney Bowes Inc., Stamford, Conn.

[21] Appl. No.: 174,866

[22] Filed: Dec. 29, 1993

[51] Int. Cl.[6] ..... B65H 1/00

[52] U.S. Cl. ..... 271/171; 271/2

[58] Field of Search ..... 271/2, 223, 241, 253, 271/255, 171; 221/44, 241

[56] References Cited

U.S. PATENT DOCUMENTS

| | | | |
|---|---|---|---|
| D. 327,906 | 7/1992 | Pike et al. | D18/51 |
| 1,107,556 | 8/1914 | Turck . | |
| 2,614,837 | 10/1952 | Cuthbert, Jr. | 271/39 |
| 2,752,696 | 7/1956 | Black | 34/149 |
| 3,977,688 | 8/1976 | Bologna et al. | 281/165 |
| 4,058,908 | 11/1977 | Weber | 34/149 |
| 4,354,671 | 10/1982 | Bergland | 270/58 |
| 4,548,400 | 10/1985 | Foster et al. | 271/226 |
| 4,688,708 | 8/1987 | Irvine et al. | 225/100 |
| 4,850,580 | 7/1989 | Denzin et al. | 271/2 |
| 4,925,180 | 5/1990 | Golicz | 271/198 |
| 4,973,037 | 11/1990 | Holbrook | 271/2 |
| 4,991,831 | 2/1991 | Green | 271/171 X |
| 5,180,357 | 1/1993 | Marzullo | 493/420 |

*Primary Examiner*—H. Grant Skaggs
*Assistant Examiner*—Carol L. Druzbick
*Attorney, Agent, or Firm*—Robert H. Whisker; Melvin J. Scolnick

[57] ABSTRACT

In apparatus for feeding respective sheets including framework and a deck mounted thereon for supporting a plurality of sheets in an upright stack thereof, wherein the deck defines a path of travel for respective lowermost sheets to be fed from the stack, and the stack has an upstream end and a downstream end, an improvement for facilitating feeding lowermost sheets from the stack, the improvement comprising a platform connected to the framework, the platform including a base wall portion having a longitudinal length extending upstream from the upstream end of the deck; a stack supporting member, the member including an upright upper wall portion having a lower end, the member including a lower wall portion extending upstream from the upper wall portion's lower end and forming therewith an elongate downstream marginal edge having a wedge-shaped transverse cross-section; and structure for adjustably mounting the stack supporting member on the platform, the mounting structure including first structure for moving the stack supporting member transversely of the longitudinal length of the platform, and second structure for moving the stack supporting member along the longitudinal length of the platform and thus toward and away from the stack for selectively positioning the stack supporting member's downstream marginal edge beneath the stack.

6 Claims, 3 Drawing Sheets

TO A.C. POWER SUPPLY
CONTROL SYSTEM
KEYBOARD
MICROPROCESSOR

SHEET FEEDING APPARATUS INCLUDING MEANS FOR FACILITATING FEEDING LOWERMOST SHEETS FROM A STACK THEREOF

BACKGROUND OF THE INVENTION

This invention is generally concerned with apparatus for feeding sheets, and, more particularly, with such apparatus including means for facilitating feeding lowermost sheets, one at a time, from an upright stack of sheets disposed on a deck.

U.S. Pat. No. 3,977,668 for DUAL PURPOSE SHEET MATERIAL FEEDING AND SAFETY APPARATUS, issued Aug. 31, 1976 to Bologna, et al. and assigned to the assignee of the present invention, discloses an upright stack of sheets which is supported on a feed deck inclined at an angle relative to an upright wall for urging an edge of each of the sheets into registration with the wall. In addition, there is disclosed opposed output feed rollers situated at the junction between the deck and wall for feeding respective sheets one at a time from the bottom of the stack.

U.S. Pat. No. 4,973,037 for a FRONT END FEEDER FOR MAIL HANDLING MACHINE, issued Nov. 27, 1990 to Holbrook and assigned to the assignee of the present invention, discloses sheet feeding apparatus comparable to the apparatus shown in the aforesaid '688 patent, for use in a high speed machine for handling mixed mail pieces, wherein a drive assembly is provided for feeding successive mailpieces from the bottom of the stack of sheets while maintaining the mailpieces in registration with a fence and fluffing the stack to promote separation of the respective mailpieces from one and other.

When the aforesaid sheet feeding apparatus, and like structures, are utilized for feeding lowermost envelopes or other sheets, one at a time from the bottom of a stack thereof, the stack of sheets may weigh so much that the frictional forces exerted by the stack and deck against the lowermost sheet are such that the lowermost sheet either cannot be fed from the stack or is misfed therefrom. This ordinarily occurs in due to the forces exerted by the feed roller beneath the stack being insufficient to overcome the static frictional forces exerted by the deck and stack on the lowermost sheet or, as the lowermost sheet is exiting the stack, due to the normal force exerted by the stack on the lowermost sheet being insufficient to permit the outfeed rollers to frictionally engage and feed the sheet from beneath the stack. In any event, any given lowermost sheet being fed from the bottom of a stack is subject to different forces in the course of being fed therefrom. Accordingly:

an object of the invention is to provide structure for facilitating feeding successive lowermost sheets from the bottom of a stack thereof, including means for reducing the frictional force exerted on the lowermost sheet in the course of feeding the same;

another object is to provide such facilitating structure for urging successive lowermost sheets toward the outfeed rollers to facilitate feeding thereby; and another object is to provide such facilitating structure for reducing the weight of the stack on respective lowermost sheets as they are sequentially fed from beneath the stack.

SUMMARY OF THE INVENTION

In apparatus for feeding respective sheets including framework and a deck mounted thereon for supporting a plurality of sheets in an upright stack thereof, wherein the deck defines a path of travel for respective lowermost sheets to be fed from the stack, and the stack has an upstream end and a downstream end, an improvement for facilitating feeding lowermost sheets from the stack, the improvement comprising: a platform connected to the framework, the platform including a base wall portion having a longitudinal length extending upstream from the upstream end of the deck; a stack supporting member, the member including an upright upper wall portion having a lower end, the member including a lower wall portion extending upstream from the upper wall portion's lower end and forming therewith an elongate downstream marginal edge having a wedge-shaped transverse cross-section; and means for mounting the stack supporting member on the platform, the mounting means including first means for moving the stack supporting member transversely of the longitudinal length of the platform, and second means for adjustably moving the stack supporting member along the longitudinal length of the platform and thus toward and away from the stack for selectively positioning the stack supporting member's downstream marginal edge beneath the stack.

BRIEF DESCRIPTION OF THE DRAWINGS

As shown in the drawings, wherein like reference numerals designate like or corresponding parts throughout the several views.

DESCRIPTION OF THE PREFERRED EMBODIMENTS

Figure 1:
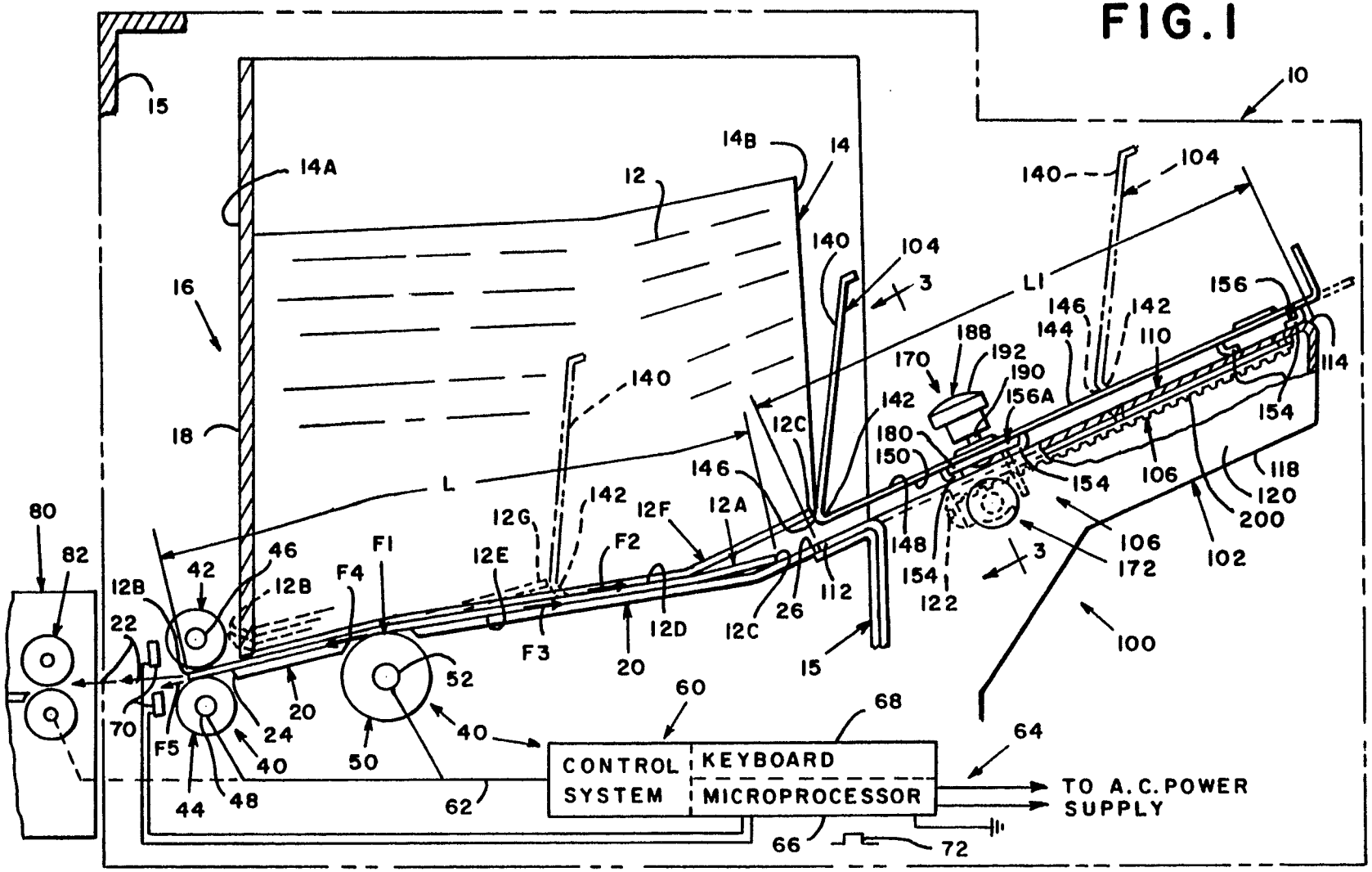
FIG. 1 is a schematic elevation of the sheet feeding structure according to the invention for feeding successive lowermost sheets from a stack thereof.

As shown in FIG. 1, according to the invention there is provided apparatus 10 for feeding successive lowermost sheets 12A from an upright stack 14 of sheets 12. The stack 14 has a front end 14A and a rear end 14B, and the apparatus 10 generally includes conventional framework 15 for supporting the various components of the apparatus 10. The sheet feeding apparatus 10 includes structure 16 for supporting a plurality of the sheets 12 in the stack 14, including a substantially vertically extending, upright, wall 18. In addition, the supporting structure 16 includes a deck 20 which extends beneath the wall 18 for defining a path of travel 22 extending therebeneath in which the successive lowermost sheets 12A are fed from the stack 14. The deck 20 is preferably inclined upwardly from the downstream end 24 thereof to the upstream end 26 thereof, for urging the respective sheets 12 of the stack 14 into edge registration with the upright wall 18. And, the deck 20 extends transverse to the path of travel 22 of the sheets 12 fed from the stack 14.

The sheet feeding apparatus 10 (FIG. 1) also includes structure 40 for successively feeding the sheets 12 downstream in the path of travel 22. Thus, each of the sheets 12 in the path of travel 22 has a leading or front edge 12B and a trailing edge or rear edge 12C, and has a predetermined overall length "L" as measured along the path of travel 22 from the leading edge 12B to trailing edge 12C thereof. The feeding structure 40 preferably includes a pair of opposed upper and lower outfeed rollers, respectively designated 42 and 44. The outfeed rollers, 42, 44, are each elongate rollers which are respectively conventionally coaxially mounted on shafts 46 and 48. The shaft 46, which is preferably an idler shaft, and the shaft 48, which is preferably a drive shaft, are respectively suitably journaled to the framework 15 for rotation so that the respective rollers, 42, 44, longitudinally extend transverse to the path of travel 22, downstream of the upright wall 18, for engaging and feeding sheets 12 fed therebetween from the stack 14. The feeding structure 40 also includes an elongate, pre-feed, roller 50, which is conventionally coaxially mounted on a drive shaft 52. The drive shaft 52 is suitably journaled to the framework 15 for rotation, so that the pre-feed roller 50 longitudinally extends transverse to the path of travel 22, upstream of the upright wall 18.

For controlling the outfeed roller 44 (FIG. 1) and pre-feed roller 50, the sheet feeding structure 40 may include any conventional control system 60. The control system 60 is preferably suitably connected to the outfeed and pre-feed roller drive shafts, 48, 52, as by means of a conventional electro-mechanical drive train 62, and is conventionally adapted to be connected to an external source of supply of A.C. power. In addition, the control system 60 preferably includes a conventional microprocessor 66, and a keyboard 68 connected thereto to permit an operator to interface with the control system 60 to enter data corresponding the overall "L" length of the respective sheets 12 of the stack 14 and to start and stop the sheet feeding structure 60. Moreover, the control system 40 preferably includes a conventional sensing device 70 located downstream of the outfeed rollers, 42, 44, for sequentially sensing the leading and trailing edges, 12B, 12C, of respective lowermost sheets 12A fed from the apparatus 10 and providing signals to the microprocessor 66, such as the signal 72, indicating that the leading and trailing edges, 12B, 12C, have been sensed.

As shown in FIG. 1, the weight of the stack 14 on the pre-feed roller 50, exerts a vertically oriented forces F1 against the pre-feed roller 50, whether or not sheets 12 are fed from the stack 14. Assuming sheet feeding is commenced, then, as a given lowermost sheet 12A is initially being fed from the stack 14 by the pre-feed rollers 50, the stack 14 exerts an upstream directed frictional force $F_2$ against the upper surface 12D of the lowermost sheet 12A and, in addition, the deck 20 exerts an upstream directed frictional force $F_3$ against the lower surface 12E of the lowermost sheet 12A. Moreover, the upstream directed frictional forces, $F_2$, $F_3$, are exerted against a downstream directed force $F_4$ exerted by the pre-feed rollers 50, against the lowermost sheet 12A. As the lowermost sheet 12 is fed to and between the outfeed rollers, 42, 44, the outfeed roller 42 exerts a downstream directed frictional force $F_5$ against the moving lowermost sheet 12A. As sheet feeding continues, the sensing device 70 senses passage of the leading edge 12B of the moving sheet 12A and provides a signal 72 indicative thereof to the microprocessor 66. Moreover, as sheet feeding continues, the upstream directed frictional forces, $F_2$, $F_3$ are continually reduced as a shorter and shorter portion of the overall length "L" of the lowermost sheet 12A is disposed in engagement the stack 14 and deck 20. Eventually, the trailing edge 12C of the lowermost sheet 12A disengages the pre-feed roller 50, and the microprocessor 66 causes the control system to stop driving the pre-feed roller 50. Whereupon, the outfeed rollers, 42, 44, feed the lowermost sheet 12A from the stack 14, against the greatly diminished upstream directed frictional forces, $F_2$, $F_3$, exerted by the stack 14 and deck 20. As the lowermost sheet 12A is fed from beneath the stack 14, as above discussed, the lowermost sheet 12 is fed downstream to any conventional structure 80, such as any suitable printing, folding, inserting or other sheet processing structure forming a part of, or externally of, the apparatus 10. Preferably, the structure 80 is equipped, as by means of conventional take-away rollers 82, for receiving and feeding the lowermost sheets 12A away from the apparatus 10. As the lowermost sheet 12A is fed away from the apparatus 10, the sensing device 70 senses passage of the trailing edge 12C of the moving sheet 12, and provides a signal 72 indicative thereof to the microprocessor 66. Whereupon, after a predetermined time delay "td" from the microprocessor 66 receiving the signal 72, the microprocessor 66 causes the control system 60 to start driving the pre-feed roller 50 to commence feeding the next lowermost sheet 12F from the stack 14, and so on, until the stack 14 of sheets 12 is depleted.

According to the invention, the apparatus 10 (FIG. 1) includes structure 100 for facilitating feeding lowermost sheets 12A from the stack 14. The facilitating structure 100 generally includes a platform 102 which is conventionally removably connected to the framework 15 for supporting the various components of the facilitating structure 100, including the platform 102. In addition, the facilitating structure 100 generally includes a stack supporting member 104, for raising the rear end 14B of the stack 14 above the deck 20 to decrease the weight of the stack 14 on the deck 20 and further incline the stack 14 toward the wall 18. Moreover, until fed from the member 104, the lowermost sheet 12A is elevated above the deck 20 sufficiently to significantly increase the tendency thereof to be urged toward the outfeed rollers, 42, 44. And, when the lowermost sheet 12 is fed from the member 104, the upstream directed frictional forces, $F_2$, $F_3$ exerted by the stack 14 and deck 20 on the lowermost sheet 12A are considerably reduced, due to partially relieving the weight of the stack 14 from the lowermost sheet 12A and thus the weight exerted by the lowermost sheet on the deck 20. Further, the facilitating structure 100 generally includes structure 106 for adjustably mounting the stack supporting member 104 on the platform 102.

Figure 2:
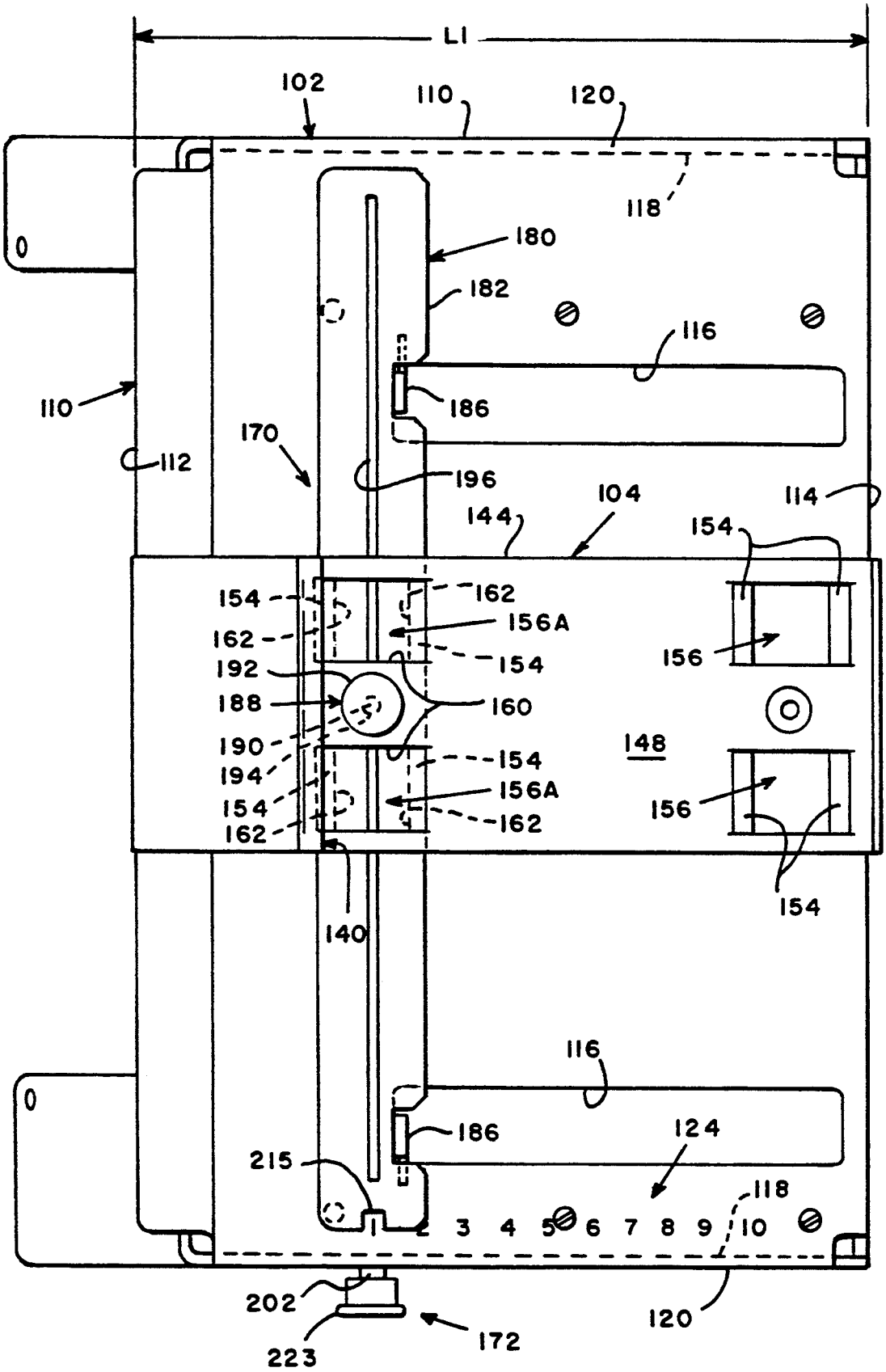
FIG. 2 is partial plan view of the sheet feeding apparatus of FIG. 1 including structure for facilitating feeding lowermost sheets from the stack.

The platform 102 (FIG. 1) preferably includes a base wall portion 110 having a longitudinal length "L1" extending upstream or rearwardly from the upstream end 26 of the deck 20. Preferably, the base wall portion 110 is upwardly inclined from deck's upstream end 26 and includes a front or downstream end 112 and a rear or upstream end 114. The base wall portion 110 also includes at least one, and preferably a pair of, elongate, substantially rectangularly-shaped and parallel-spaced, first, apertures 116 (FIG. 2), which are formed therein so as to longitudinally extend at least partially between the base wall portion's downstream and upstream ends, 112, 114. The platform 102, (FIG. 1) further includes at least one, and preferably a pair of, oppositely spaced side wall portions 118 depending from the base wall portion 110 and forming therewith a pair of opposed, longitudinally-extending, marginal side edges 120 (FIG. 2). Preferably, one of the depending side wall portions 118 includes an elongate, substantially rectangularly-shaped, second aperture 122 (FIG. 1), which is formed therein so as to longitudinally extend substantially parallel to the upper wall portion 110. And, alongside of the marginal side edge 120 (FIG. 2) bordering the depending side wall portion 118 which includes the second aperture 122, the platform's upper wall portion 110 preferably includes a relative distance scale 124 marked thereon.

The stack supporting member 104 (FIG. 1) preferably includes an elongate, substantially rectangularly-shaped, upright, upper wall portion 140, having a lower end 142, and includes an elongate, substantially rectangularly-shaped, lower wall portion 144. The lower wall portion 144 extends upstream or rearwardly from the upper wall portion's lower end 142 and forms therewith a transversely-extending downstream, or front, marginal edge 146, having a wedge-shaped transverse cross-section. The lower wall portion 144 has an upper surface 148 and a lower surface 150. In addition, the lower wall portion 144 includes at least one pair, and preferably a plurality of pairs, of elongate, substantially parallel-spaced, converging, finger members 154 which respectively depend from the lower wall portion 144 and extend transversely thereof. The finger member 154 of each pair thereof, laterally extend toward each other to form, with the lower wall portion's lower surface 150, a slideway 156. Each of the slideways 156 is substantially rectangularly-shaped in transverse cross-section, and extends transversely of the lower wall portion 144. Thus the lower wall portion 144 preferably includes a plurality of parallel-spaced slideways 156. As shown in FIG. 2, according to the invention, the depending finger members 154 of, for example, the slideway 156A, are preferably formed by means of cutting a plurality of substantially rectangularly-shaped, parallel-spaced, apertures 160 in the lower wall portion 144, and bending the opposed front and rear marginal edges 162 of each aperture 160 away from the lower wall portion's upper surface 148 to form the depending finger members 154.

The structure 106 (FIG. 1) for adjustably mounting the stack supporting member 104 on the platform 102, generally includes a first structure 170 for adjustably moving the stack supporting member 104 transversely of the longitudinal length "L1" of the platform 102, and a second structure 172 for adjustably moving the stack supporting member 102 along the longitudinal length "L1" of the platform 102.

For transversely moving the stack supporting member 104 (FIG. 1), the first structure 170 includes a rail 180 (FIG. 2). The rail 180 includes an elongate, substantially rectangularly-shaped, slide portion 182. The slide portion 182 extends transversely of and in overlaying relationship with the platform's base wall portion 110. The slide portion 182 is preferably dimensioned for slidably mounting the stack supporting member 104, by means of one of the slideways 156 thereof, on the slide portion 182, for slidably moving the stack supporting member 104 transversely of the platform 102. The rail 180 additionally includes at least one, and preferably two, tab portion 186, depending upon whether the platform 102 is provided with one or two apertures 116. The tab portions 186, which depend from the slide portion 182 at spaced intervals along the longitudinal length thereof, extend through the platform apertures 116 and into locking relationship with the platform 102 when the second, member-moving, structure 172 (FIG. 3) is locked against movement as hereinafter discussed. Preferably, the first, member-moving, structure 170 (FIG. 2) also includes structure 188 for adjustably fixedly locating the stack supporting member 104 on the rail's slide portion 182, to locate the member 104 transversely of the longitudinal length "L1" of the platform 102. To that end, the structure 188 includes an externally threaded locking shaft 190 (FIG. 1) and a manually graspable knob 192 connected to the shaft 190 for rotation thereof. In addition, the stack supporting member's lower wall portion 144 (FIG. 2) includes an internally threaded aperture 194 formed therein which is dimensioned for threadably receiving the locking shaft 190 (FIG. 1). Moreover, the rail's slide portion 182 (FIG. 2) includes an elongate channel 196, which is formed therein for receiving the locking shaft 190 (FIG. 1) in bearing engagement therewith. As thus constructed and arranged, upon tightening the locking shaft 190 in bearing engagement with the rail's slide portion 196 (FIG. 2), the slideway's depending finger members 154 are jacked upwardly and into engagement with the rail's slide portion 182 for fixedly locating the stack supporting member 104 along the longitudinal length of the rail's slide portion 182. Accordingly, the stack supporting member 104 (FIG. 1) is constructed and arranged to be selectively positionable transversely of the platform 102, and thus transversely of the rear end 14B of the stack 14 for centering the member's upper wall portion 140 relative to the stack's rear end 14B.

Figure 3:
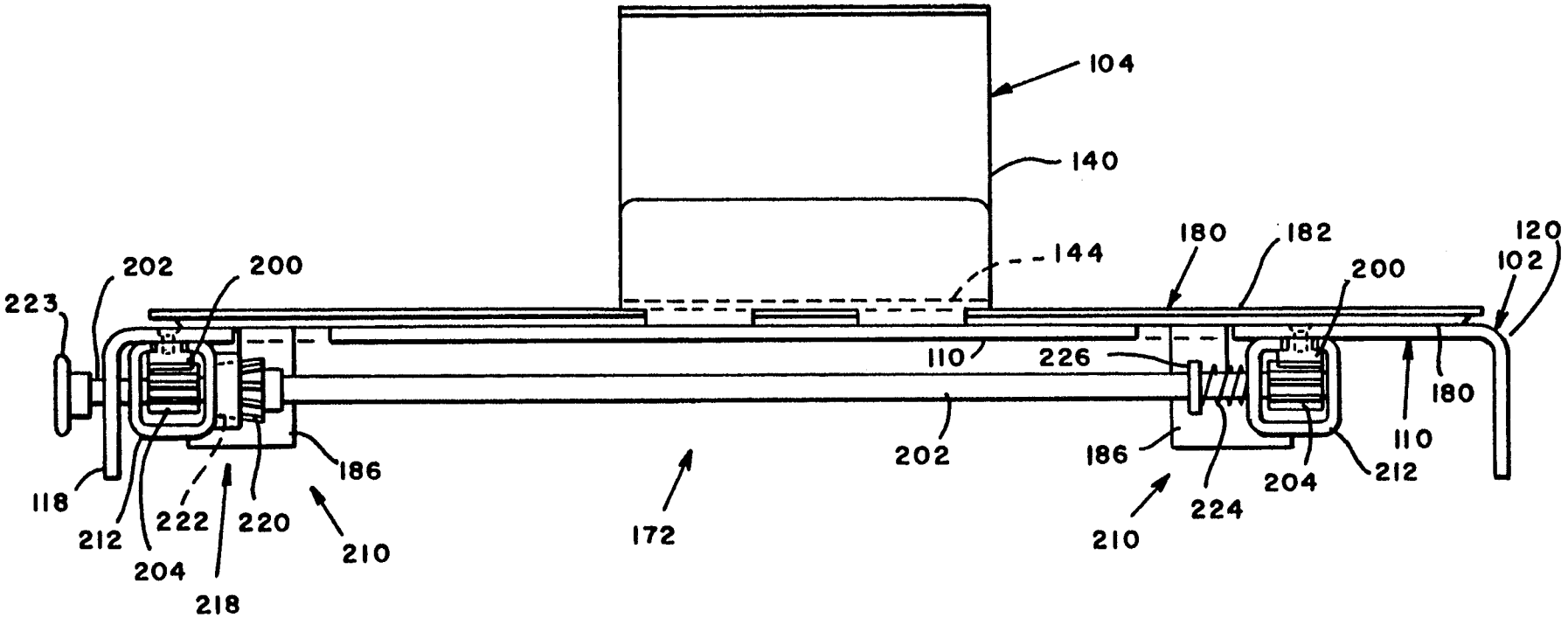
FIG. 3 is an elevation taken substantially along the line 3—3 of FIG. 1.

For adjustably moving the stack supporting member 104 (FIG. 2) along the longitudinal length "L1" of the platform 102, and thus toward and away from the stack 14, the second, member-moving, structure 172 (FIG. 3) preferably includes at least one, and preferably two, rack gears 200 which are fixedly attached to the platform's base wall portion 110 so as to depend therefrom. Thus the rack gears 200 extend downwardly beneath the base wall portion 110. In addition, the second, member-moving structure 172 includes an elongate shaft 202 which extends beneath and transversely of the longitudinal length "L1" (FIG. 2) of the base wall portion 110 (FIG. 3). Further, the second structure 172 includes at least one, and preferably two, pinion gears 204, each of which is attached to the shaft 202 for rotation therewith and is disposed in meshing engagement with rack gear 200. Preferably, each of the gears 204 is attached to the shaft 202, as by keying the shaft 202 and gears 204 to one another, in a manner such that the shaft 202 is longitudinally movable axially of the gear(s) 204. In addition, the second structure 172 includes at least one, and preferably two, hollow, carriage members 212, which are each slidably connected to the one of the rack gears 200 so as to depend therefrom. To that end, the respective rack gear's 200 are T-shaped in transverse cross-section, and the respective carriage members 212 are C-shaped in transverse cross-section. In addition, each of the depending tab portions 186 of the rail 180 are conventionally fixedly attached to one of the carriage members 212 for movement therewith. Moreover, the shaft 202 extends through the respective carriage members 212 for support thereby, and the respective pinion gears 204 are keyed to the shaft 202 within the carriage members 212. As thus constructed and arranged, rotation of the shaft 202, and thus the pinion gears 204, causes the pinion gears 204 to move the shaft 202 in the direction of the longitudinal length "L1" of the platform's upper wall portion 110. As the shaft 202 is moved, the carriage member(s) 212 are slidably moved along the rack gear(s) 200. And, since the depending tab portions 186 are fixed to the carriage members 212, the rail 180 and stack supporting member 104 are carried along the longitudinal length "L1" of the platform's upper wall portion 110, as the shaft 202 rotates. Accordingly, rotation of the shaft 202 results in movement of the stack supporting member 104 either toward or away from the stack 14, depending upon the direction of rotation of the shaft 202. As thus constructed and arranged, the stack supporting member's wedge-shaped marginal edge 146 may be moved downstream sufficiently to raise the rear end 14B of a given stack 14 of sheets 12 or envelopes 12G independently of their size as measured between the front and rear ends, 14A, 14B, thereof. Preferably, for repeatedly positioning the stack supporting member 104 in a given position along the longitudinal length "L1" of the platform 102 the rail's slide portion 182 includes a slot 215 (FIG. 2) formed therein. As the rail's slide portion 182 is moved in overlying relationship with the scale 124, the slot 215 may be observed for reading the scale 124 therethrough to repeatedly locate the rail 180 and thus the stack supporting member 104 in a selected position relative to a given marking on the scale 124.

Further, for locking the shaft 202 (FIG. 3) against rotation, the second, member-moving, structure 172 preferably includes locking structure 218. The locking structure 218 includes an externally splined annulus 220, which is conventionally fixedly attached to the shaft 202. In addition, the locking structure 218 includes providing the carriage member 212 with an internally splined aperture 222, which is dimensioned for receiving the annulus 220. In addition, the locking structure 218 includes a knob 223 mounted on the free end of the shaft 202, and includes a spring 224, which is conventionally fixedly attached to the shaft, as by means of a suitable fastener 226, for normally resiliently urging the annulus 220 into locking engagement with the carriage member's internally splined aperture 222. For unlocking the shaft 220, the operator may manually push the shaft 202 in the direction of the longitudinal length thereof, to disconnect the annulus 220 from carriage member's aperture 222 against the force exerted by the spring 224. Thus the shaft 202 is normally held by the spring 224 in a first position, wherein the shaft 202 is locked against rotation. And, the shaft 202 is manually movable against the force exerted by the spring 224 to a second position, wherein the shaft 202 is manually rotatable, to permit rotation of the shaft 202, and thus movement of the stack supporting member 104 toward and away from the stack 14.

What is claimed is:

1. In an apparatus for feeding respective sheets including framework and a deck mounted thereon for supporting a plurality of sheets in an upright stack thereof, wherein the deck defines a path of travel for respective lowermost sheets to be fed from the stack, and the stack has an upstream end and a downstream end, and improvement for facilitating feeding lowermost sheets from the stack the improvement comprising:

(a) a platform connected to the framework, the platform including a base wall portion having a longitudinal length extending upstream from the upstream end of the deck;

(b) a stack supporting member;

(c) means for adjustably mounting the stack supporting member on the platform, the mounting means including first means for moving the stack supporting member transversely of the longitudinal length of the platform, and second means for moving the stack supporting member along the longitudinal length of the platform and thus toward and away from the stack for selectively positioning the stack supporting member's downstream marginal edge beneath the stack, the stack supporting member comprising;

(i) an adjustably fixed connection to the first moving means, the improvement further including means for connecting the first and second moving means to connect the second moving means and stack supporting member to one another;

(ii) an upright upper wall portion having a lower end and a lower wall portion extending upstream from the upper wall portion's lower end and forming therewith an elongate downstream marginal edge having a wedge shaped transverse cross-section; and (iii) a slideway, the first moving means including a rail, the rail including an elongate slide portion extending transversely of and in overlaying relationship with the platform's base wall portion, the slide portion dimensioned for mounting thereon the stack supporting member's slideway for slidably moving the member transversely of the platform, and the first moving means including means for adjustably fixedly locating the member on the slide portion.

2. The improvement according to claim 1, wherein the second moving means includes a rack gear depending from the platform's base wall portion, the second moving means including an elongate shaft extending beneath and transversely of the longitudinal length of the platform's base wall portion, the second moving means including a pinion gear attached to the shaft for rotation therewith, the pinion gear disposed in meshing engagement with the rack gear for movement of the shaft and thus the stack supporting member.

3. The improvement according to claim 1, wherein the second moving means includes a rack gear depending from the platform's base wall portion, the base wall portion including an elongate aperture formed therein and extending along the longitudinal length thereof, the second moving means including an elongate shaft extending beneath and transversely of the longitudinal length of the platform's base wall portion, the second moving means including a pinion gear attached to the shaft for rotation therewith and disposed in meshing engagement with the rack gear, the pinion gear attached to the shaft such that the shaft is slidably movable axially of the pinion gear, means for manually rotating the shaft for movement of the stack supporting member toward and away from the stack, and means for adjustably fixedly locating the shaft and thus the stack supporting member along the longitudinal length of the platform.

4. The improvement according to claim 3, wherein the second moving means includes a hollow carriage member within which the pinion gear is attached to the shaft and axially slidably connected thereto, the rail including a tab portion depending from the slide portion, the tab portion extending through the platform aperture and connected to the carriage member, the locating means including means for moving the shaft between a first position wherein the shaft is locked against rotation and a second position wherein the shaft is manually rotatable, and the locating means including means for locking the shaft against rotation.

5. The improvement according to claim 4, wherein the locking means includes an externally splined annulus fixedly attached to the shaft, the locking means including the carriage member having an internally splined aperture formed therein for receiving the annulus, and the locking means including a spring connected to the shaft for normally resiliently urging the annulus into splined engagement with the carriage member aperture and thus into locking relationship therewith.

6. The improvement according to claim 1, wherein the means for adjustably locating the member on the slide portion includes the stack supporting member's lower wall portion having an internally threaded aperture formed therein, the locating means including an externally threaded locking shaft threadably mounted in the threaded aperture, and a knob fixedly connected to the threaded shaft for rotation thereof to urge the threaded shaft into bearing engagement with the slide portion.

* * * * *